US005607049A

United States Patent [19]

Shioda

[11] Patent Number: 5,607,049

[45] Date of Patent: Mar. 4, 1997

[54] ROCKING SWITCH

[75] Inventor: Kazuya Shioda, Niwa-gun, Japan

[73] Assignee: Kabushiki Kaisha Tokai Rika Denki Seisakusho, Aichi, Japan

[21] Appl. No.: 559,422

[22] Filed: Nov. 15, 1995

[30] Foreign Application Priority Data

Nov. 18, 1994 [JP] Japan ..... 6-309815

[51] Int. Cl.[6] ..... H01H 21/24

[52] U.S. Cl. ..... 200/557; 200/553; 200/5 R; 200/61.54; 200/6 A

[58] Field of Search ..... 200/557, 556, 200/553, 561, 339, 554, 555, 558, 559, 560, 562, 563, 5 R, 61.54, 6 A

[56] References Cited

U.S. PATENT DOCUMENTS

| | | | |
|---|---|---|---|
| 2,808,482 | 10/1957 | Zanichkowsky et al. | 200/553 |
| 3,115,555 | 12/1963 | Lescarboura | 200/557 |
| 3,281,545 | 10/1966 | Pierce | 200/557 |
| 4,027,119 | 5/1977 | Tezuka | 200/6 A |

*Primary Examiner*—David J. Walczak
*Attorney, Agent, or Firm*—Hickman Beyer & Weaver

[57] ABSTRACT

A tilt and telescopic switch 10 includes a main body 19 received and accommodated in the space defined by a first hemispherical recess 38 of an upper casing member 12 and a second hemispherical recess 60 of a lower casing member 14. The main body 19 accommodated in the space continuously receives the pressing force of a spring 44 and allows a first hemispherical member 28 of the main body 19 to come into contact with the first hemispherical recess 38 along the substantially whole surface thereof. The first hemispherical member 28 of the main body 19 is thus guided by the hemispherical inner surface of the first hemispherical recess 38, so that the main body 19 rocks from its neutral position in the direction shown by the double-headed arrow X or in the direction shown by the double-headed arrow Y. Even when the main body 19 is guided and rocked by only one side of the first hemispherical recess 38 to cause a deviation of the center of the rocking movement of the main body 19 from the center of the hemispherical surface of the first hemispherical member 28, the structure of the invention allows only hemispherical projections 31*a* through 31*d* formed on a second hemispherical member 31 to come into contact with the second hemispherical recess 60.

15 Claims, 7 Drawing Sheets

ROCKING SWITCH

BACKGROUND OF THE INVENTION

1. Field of the Invention

The present invention relates to a rocking switch which rocks forward from its neutral position to a first rocking position and back from the neutral position to a second rocking position and outputs predetermined switching signals at the respective rocking positions.

2. Description of the Related Art

In a known structure of rocking movement-activated switches, a main body itself is supported by a rocking shaft in the manner that allows free rocking movements of the main body. This structure restricts the rocking movements to one direction in order to realize only one type of switching operation for a fixed purpose. As long as this conventional structure is applied, separate switches are required to realize two different types of switching operations for two different purposes. The separate switches, however, undesirably increase the required space.

An improved structure proposed to save the space allows only one switch to realize two different types of switching operations for two different purposes. A tilt and telescopic switch mounted on a vehicle is given as a typical example of the switches of such improved structure. The tilt and telescopic switch is used to vary the angle of inclination of a steering wheel and change the axial position of the steering wheel according to the physical constitution or requirements of a driver. The tilt and telescopic switch implements the tilt switching for varying the angle of inclination based on rocking movements in a first direction and the telescopic switching for changing the axial position based on rocking movements in a second direction, which is different from the first direction.

As shown in the cross sectional view of FIG. 10, a conventional tilt and telescopic switch 50 includes a switch casing 16 assembled by fitting a lower casing member 14 into a lower opening of an upper casing member 12, and a main body 18 received and accommodated in the space defined by the switch casing 16. The main body 18 has a knob fixing member 22, which is projected upright through an upper opening 20 formed in the upper casing member 12. A control knob 24 is fixed to the knob fixing member 22 by means of a pin 26.

The main body 18 includes a first hemispherical member 28 on the side close to the control knob 24 and a second hemispherical member 30 on the side away from the control knob 24. The second hemispherical member 30 is disposed on the lower end of the main body 18 and concentrically arranged with the first hemispherical member 28. The knob fixing member 22 is integrally joined with the outer top portion of the first hemispherical member 28, whereas the second hemispherical member 30 is joined with the inner top portion of the first hemispherical member 28.

A plane ring 32 is formed as a rim of the lower opening of the first hemispherical member 28. Four pressure projections 34*a*, 34*b*, 34*c*, and 34*d* are arranged at the equal pitches on the lower face of the plane ring 32. Only the two pressure projections 34*a* and 34*b* are shown in FIG. 10 and the other pressure projections 34*c* and 34*d* (not shown) are located in front of and behind the sheet surface of FIG. 10. Four switching elements 36*a*, 36*b*, 36*c*, and 36*d* are disposed on the upper face of the lower casing member 14 at positions corresponding to those of the four pressure projections 34*a*, 34*b*, 34*c*, and 34*d* so as to face the respective pressure projections 34*a* through 34*d*. Only the two switching elements 36*a* and 36*b* are shown in FIG. 10 and the other switching elements 36*c* and 36*d* (not shown) are located in front of and behind the sheet surface of FIG. 10. The switching elements 36*a* through 36*d* output switching signals when downward pressure is applied to the respective upper faces of the switching elements 36*a* through 36*d* by means of the pressure projections 34*a* through 34*d* formed on the lower face of the plane ring 32.

The upper casing member 12 has a first hemispherical recess 38 formed to define the opening 20. The outer radius of the first hemispherical member 28 of the main body 18 is substantially equal to the inner radius of the first hemispherical recess 38. The lower casing member 14 has a second hemispherical recess 40, which faces the opening 20 and the first hemispherical recess 38 of the upper casing member 12. The second hemispherical recess 40 is arranged concentrically with the first hemispherical recess 38 and combined with the second hemispherical member 30 of the main body 18 to define a clearance therebetween.

A chamber 41 formed in the center of the second hemispherical member 30 of the main body 18 receives a touch piece 42 and a spring 44 for pressing the touch piece 42. The touch piece 42 is freely movable toward and away from the second hemispherical recess 40 of the lower casing member 14. A spot facing hole 45 and a through hole 46 are formed on the center of the lower end of the second hemispherical recess 40. The lower end of the touch piece 42 comes into contact and engagement with the spot facing hole 45.

The main body 18 accommodated in the switch casing 16 continuously receives the pressing force of the spring 44. The first hemispherical member 28 of the main body 18 accordingly comes into contact with the first hemispherical recess 38 over the substantially whole hemispherical surface thereof and is guided by the hemispherical inner surface of the first hemispherical recess 38. This rocks the main body 18 back and forth either in the direction shown by the double-headed arrow X or in the direction perpendicular to the direction X. The second hemispherical member 30 of the main body 18, on the other hand, is received by the second hemispherical recess 40 while not being in direct contact with or guided by the second hemispherical recess 40. The direct contact of the second hemispherical member 30 with the substantially whole hemispherical inner surface of the second hemispherical recess 40 increases the contact resistance in the rocking movements of the main body 18, thus requiring a relatively large force for operations of the control knob 24. In the structure of the embodiment, the radius of the second hemispherical recess 40 is set a little greater than the radius of the second hemispherical member 30. This ensures a clearance between the second hemispherical member 30 and the second hemispherical recess 40 and prevents the second hemispherical member 30 from being in direct contact with the second hemispherical recess 40.

In the conventional switch thus constructed, although only the first hemispherical member 28 of the main body 18 is guided by the first hemispherical recess 38, there are some cases in which a relatively large force is required for operations of the control knob. This is attributable to the following.

The respective elements of the tilt and telescopic switch 50 are generally made of resin because of its light weight advantage and excellent forming properties. The shapes and dimensions of the respective elements are determined in the process of design. For example, the outer radius of the first hemispherical member 28 of the main body 18 is set substantially equal to the inner radius of the first hemispherical recess 38 of the upper casing member 12. The radius of the second hemispherical recess 40 of the lower casing member 14 is set a little greater than the radius of the second hemispherical member 30 of the main body 18. The inner diameter of the chamber 41 formed in the center of the second hemispherical member 30 is designed to be a little greater than the dimensions of the touch piece 42, in order to allow the touch piece 42 to be freely movable in the chamber 41 toward and away from the second hemispherical recess 40. Namely there is a little clearance between the wall of the chamber 41 and the touch piece 42.

Although the first hemispherical member 28 is designed to have the outer radius substantially equal to the inner radius of the first hemispherical recess 38, the inner radius of the first hemispherical recess 38 should be a little greater than the outer radius of the first hemispherical member 28 to allow the first hemispherical member 28 to be guided by the first hemispherical recess 38. When the control knob 24 is operated in the direction of the arrow X0 shown in FIG. 10, only the main body 18 rocks until the touch piece 42 comes into contact with the wall of the chamber 41. The slight difference between the outer radius of the first hemispherical member 28 and the inner radius of the first hemispherical recess 38 prevents the first hemispherical member 28 from being completely in contact with the first hemispherical recess 38 over the whole surface thereof. This may cause the main body 18 to be guided and rocked by only one side of the first hemispherical recess 38, for example, by a hemispherical portion A shown in FIG. 10. The one-sided guide results in a deviation of the center of the rocking movement of the main body 18 from the center of the hemispherical surface of the first hemispherical member 28.

The deviation of the rocking center brings the first hemispherical member 28 of the main body 18 into contact with the hemispherical portion A of the first hemispherical recess 38 and makes the main body 18 rock about the hemispherical portion A. This results in a clearance at another hemispherical portion B on the other side of the first hemispherical recess 38. A hemispherical portion C of the second hemispherical member 30 apart from the second hemispherical recess 40 thus comes into contact with the hemispherical inner surface of the second hemispherical recess 40. Irrespective of the clearance formed between the second hemispherical member 30 and the second hemispherical recess 40 to prevent a direct contact, the second hemispherical member 30 comes into contact with the second hemispherical recess 40. This may undesirably increase the force required for the operation of the control knob 24.

The sliding properties of the hemispherical inner surface of the second hemispherical recess 40 may be enhanced by applying a lubricant or improving the spherical precision. Such measures, however, do not radically settle the above problem since adhesion of dust and shrink or sink marks of the resin in the molding process are inevitable. Increasing the clearance between the second hemispherical member 30 and the second hemispherical recess 40 is not advantageous, because the increased clearance does not meet the favorable arrangement of the switching elements 36*a* through 36*d* on the upper face of the lower casing member 14, the demands for thin-walled switches, and the sufficient strength of the lower spherical recess 40. The highly precise control of dimensions of the respective elements is required to determine the minimum clearance which does not induce the above problem. This requires the thorough quality control in the manufacturing process and additional equipment for realizing the highly precise control of dimensions, thereby increasing the labor and cost.

SUMMARY OF THE INVENTION

The object of the present invention is thus to improve the operating characteristics of a rocking switch which rocks in a plurality of directions.

The above and the other related objects are realized by a rocking switch for rocking forward from a neutral position thereof to a first rocking position and back from the neutral position to a second rocking position and outputting first and second switching signals at the first rocking position and the second rocking position, respectively. The rocking switch of the invention includes:

a main body rocked forward from the neutral position to the first rocking position and back from the neutral position to the second rocking position;

a switch casing for accommodating the main body to allow rocking movements of the main body, the switch casing having an opening on one end thereof;

a first switching element, formed in the switch casing, for outputting said first switching signal, the first switching element being pressed when the main body is rocked to the first rocking position;

a second switching element, formed in the switch casing, for outputting said second switching signal, the second switching element being pressed when the main body is rocked to the second rocking position; and a control knob fixed to the main body and projected through the opening of the switch casing, the control knob causing the rocking movement of the main body from the neutral position to the first rocking position and to the second rocking position in response to a rocking-forward and -back operation of the control knob; and wherein the main body including:

a first hemispherical member formed on a first side of the main body close to the control knob;

a second hemispherical member formed on a second side of the main body away from the control knob and arranged concentrically with the first hemispherical member;

a first pressure element for pressing the first switching element when the main body is rocked to the first rocking position; and a second pressure element for pressing the second switching element when the main body is rocked to the second rocking position; and the switch casing including:

a first hemispherical recess formed to define the opening of the switch casing for guiding the first hemispherical member of the main body along the hemispherical surface thereof; and a second hemispherical recess arranged concentrically with the first hemispherical recess to accommodate the second hemispherical member of the main body.

the second hemispherical member including a pair of first projections protruded against the hemispherical inner surface of the second hemispherical recess, the pair of first projections being arranged symmetrically and opposite to each other across the neutral position in a first rocking plane defined by the neutral position, the first rocking position, and the second rocking position.

The rocking switch thus constructed includes a main body accommodated in the space defined by the first hemispherical recess of the switch casing and the second hemispherical recess facing the first hemispherical recess. The first hemispherical member of the main body is guided by the hemispherical inner surface of the first hemispherical recess. The guide along the hemispherical surface allows rocking movements of the main body in a plurality of directions. The second hemispherical member of the main body is accommodated by the hemispherical inner surface of the second hemispherical recess. The second hemispherical member has a pair of first projections protruded against the hemispherical inner surface of the second hemispherical recess. The pair of first projections are arranged symmetrically and opposite to each other across the neutral position in a first rocking plane defined by the neutral position, the first rocking position, and the second rocking position.

When the main body is rocked to the first rocking position and to the second rocking position across the neutral position in the first rocking plane, the center of the rocking movement of the main body may be deviated from the center of the hemispherical surface of the first hemispherical member. Such a deviation, however, only causes the point contact of the second hemispherical member with the hemispherical inner surface of the second hemispherical recess via one of the first projections. This structure does not increase the required force for operating the control knob and enhances the operating characteristics of the rocking switch. In response to a rocking operation of the control knob with a little operating force, the main body is rocked to either the first rocking position and the second rocking position. The rocking movement of the main body presses the first switching element or the second switching element to allow the respective switching elements to output the predetermined switching signals.

It is preferable that the rocking switch includes restoration means for returning the main body to the neutral position when the rocking-forward and -back operation of the control knob is released.

This structure allows the main body to be placed at the neutral position while the control knob is not operated or after the control knob is operated.

Each of the pair of first projections formed on the second hemispherical member preferably has a hemispherical shape or cone shape.

This structure allows the point contact of the second hemispherical member with the second hemispherical recess only via the tips of the hemispherical or cone-shaped first projections, thereby further improving the operating characteristics of the rocking switch.

In accordance with one preferable application, the switch casing further includes:

a third switching element being pressed when the main body is rocked forward from the neutral position to a third rocking position in a second rocking plane, which crosses the first rocking plane at the neutral position; and a fourth switching element being pressed when the main body is rocked back from the neutral position to a fourth rocking position in the second rocking plane, the main body further including:

a third pressure element for pressing the third switching element when the main body is rocked to the third rocking position in the second rocking plane; and a fourth pressure element for pressing the fourth switching element when the main body is rocked to the fourth rocking position in the second rocking plane, the second hemispherical member including a pair of second projections protruded against the hemispherical inner surface of the second hemispherical recess, the pair of second projections being arranged symmetrically and opposite to each other across the neutral position in the second rocking plane.

In response to a rocking operation of the control knob with a little operating force along either the first rocking face or the second rocking face, the main body is rocked to one of the first rocking position, the second rocking position, the third rocking position, and the fourth rocking position. The rocking movement of the main body presses one of the first switching element, the second switching element, the third switching element, and the fourth switching element to allow the respective switching elements to output the predetermined switching signals for different purposes.

Each of the pair of second projections formed on the second hemispherical member preferably has a hemispherical 10 shape or cone shape.

This structure allows the point contact of the second hemispherical member with the second hemispherical recess only via the tips of the hemispherical or cone-shaped second projections. The point contact allows the control knob to be controlled easily with a little operating force both in the first rocking face and the second rocking face crossing each other, thereby further improving the operating characteristics of the rocking switch.

In accordance with one preferable application, the first switching element includes a first switching signal output element for outputting the first switching signal indicating to extend an axial length of a steering wheel in a vehicle;

the second switching element includes a second switching signal output element for outputting the second switching signal indicating to shorten the axial length of the steering wheel in the vehicle;

the third switching element includes a third switching signal output element for outputting a third switching signal indicating to widen an angle of inclination of the steering wheel in the vehicle;

the fourth switching element includes a fourth switching signal output element for outputting a fourth switching signal indicating to narrow the angle of inclination of the steering wheel in the vehicle.

This structure allows the axial strength and the angle of inclination of the steering wheel to be adjusted easily and accurately with a little operating force.

The invention is also directed to another rocking switch for rocking forward from a neutral position thereof to a first rocking position and back from the neutral position to a second rocking position and outputting first and second switching signals at the first and second rocking positions, respectively. The rocking switch of another structure includes:

a main body rocked forward from the neutral position to the first rocking position and back from the neutral position to the second rocking position;

a switch casing for accommodating the main body to allow rocking movements of the main body, the switch casing having an opening on one end thereof;

a first switching element, formed in the switch casing, for outputting the first switching signal, the first switching element being pressed when the main body is rocked to the first rocking position;

a second switching element, formed in the switch casing, for outputting the second switching signal, the second switching element being pressed when the main body is rocked to the second rocking position; and a control knob fixed to the main body and projected through the opening of the switch casing, the control knob causing the rocking movements of the main body from the neutral position to the first rocking position and to the second rocking position in response to a rocking-forward and -back operation of the control knob; and wherein the main body including:

a first hemispherical member formed on a first side of the main body close to the control knob;

a second hemispherical member formed on a second side of the main body away from the control knob and arranged concentrically with the first hemispherical member;

a first pressure element for pressing the first switching element when the main body is rocked to the first rocking position; and a second pressure element for pressing the second switching element when the main body is rocked to the second rocking position; and the switch casing including:

a first hemispherical recess formed to define the opening of the switch casing for guiding the first hemispherical member of the main body along the hemispherical surface thereof; and a second hemispherical recess arranged concentrically with the first hemispherical recess to accommodate the second hemispherical member of the main body.

the second hemispherical member including a ring projection protruded against the hemispherical inner surface of the second hemispherical recess.

In this structure, the deviation of the center of the rocking movement of the main body only causes the point contact of the second hemispherical member with the hemispherical inner surface of the second hemispherical recess via part of the ring projection. This structure does not increase the required force for operating the control knob and enhances the operating characteristics of the rocking switch.

It is preferable that the rocking switch includes restoration means for returning the main body to the neutral position when the rocking-forward and -back operation of the control knob is released.

This structure allows the main body to be placed at the neutral position while the control knob is not operated or after the control knob is operated.

The ring projection formed on the second hemispherical member preferably has a hemispherical cross section or a cone cross section along the first rocking plane.

This structure allows the point contact of the second hemispherical member with the second hemispherical recess only via part of the hemispherical or cone-shaped ring projection, thereby further improving the operating characteristics of the rocking switch.

In accordance with one preferable application, the switch casing further includes:

a third switching element being pressed when the main body is rocked forward from the neutral position to a third rocking position in a second rocking plane, which crosses at the neutral position a first rocking plane defined by the neutral position, the first rocking position, and the second rocking position; and a fourth switching element being pressed when the main body is rocked back from the neutral position to a fourth rocking position in the second rocking plane; and the main body further includes:

a third pressure element for pressing the third switching element when the main body is rocked to the third rocking position in the second rocking plane; and a fourth pressure element for pressing the fourth switching element when the main body is rocked to the fourth rocking position in the second rocking plane.

In response to a rocking operation of the control knob with a little operating force along either the first rocking face or the second rocking face, the main body is rocked to one of the first rocking position, the second rocking position, the third rocking position, and the fourth rocking position. The rocking movement of the main body presses one of the first switching element, the second switching element, the third switching element, and the fourth switching element to allow the respective switching elements to output the predetermined switching signals for different purposes.

In this structure, the ring projection formed on the second hemispherical member preferably has a hemispherical cross section or a cone cross section along the first rocking plane.

This structure allows the point contact of the second hemispherical member with the second hemispherical recess only via part of the hemispherical or cone-shaped ring projection. The point contact allows the control knob to be controlled easily with a little operating force both in the first rocking face and the second rocking face crossing each other, thereby further improving the operating characteristics of the rocking switch.

These and other objects, features, aspects, and advantages of the present invention will become more apparent from the following detailed description of the preferred embodiment with the accompanying drawings.

DESCRIPTION OF THE PREFERRED EMBODIMENT

A tilt and telescopic switch is described as a preferred embodiment according to the present invention.

Figure 1:
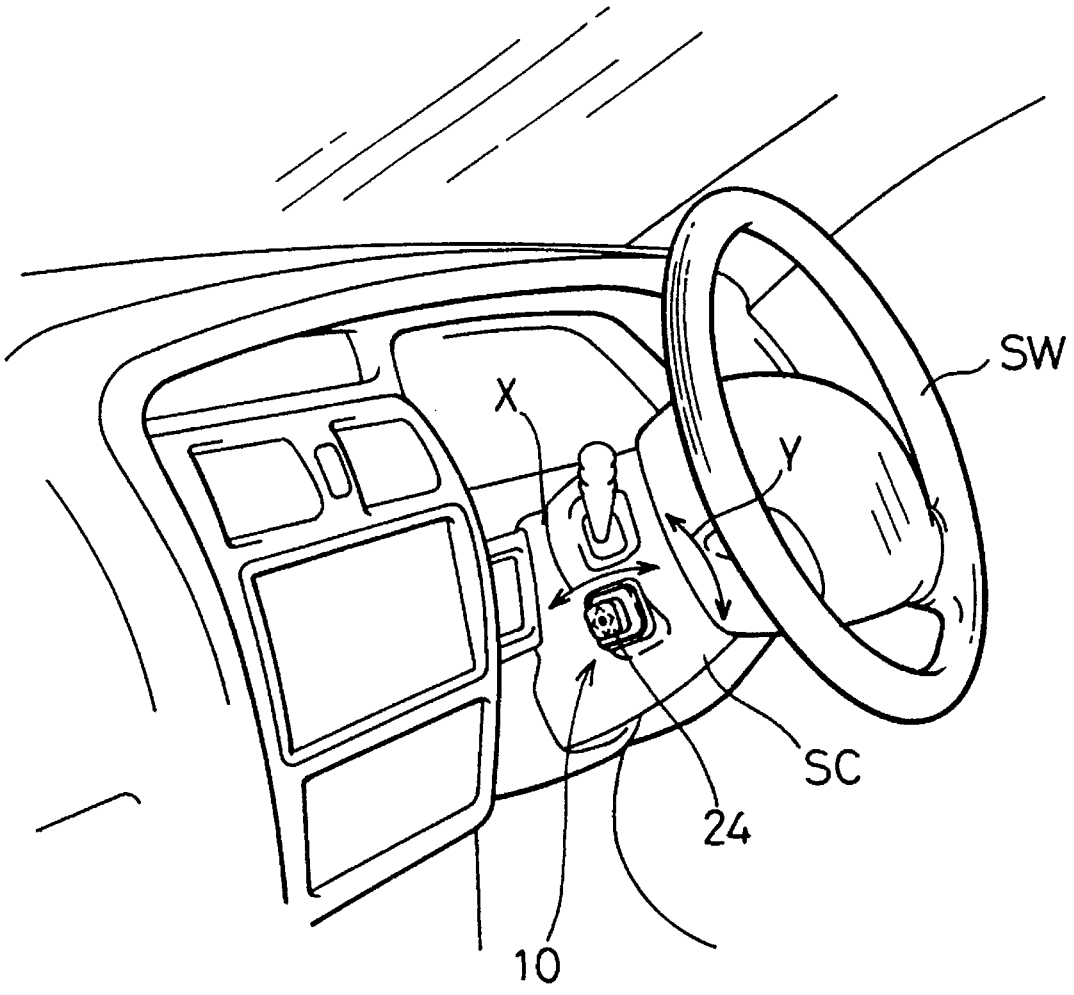
FIG. 1 is a perspective view schematically illustrating a steering wheel SW and its surrounding in a vehicle.
Figure 2:
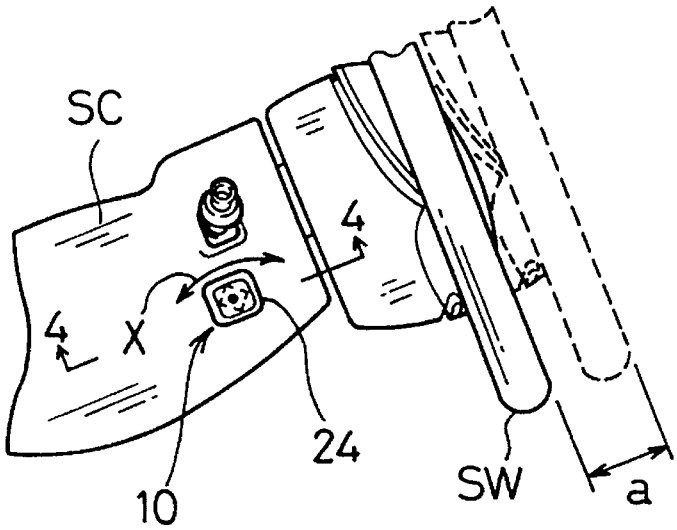
FIG. 2 shows rocking operations of a control knob 24 of a tilt and telescopic switch 10 embodying the invention in one direction to change one condition of a steering wheel SW.
Figure 3:
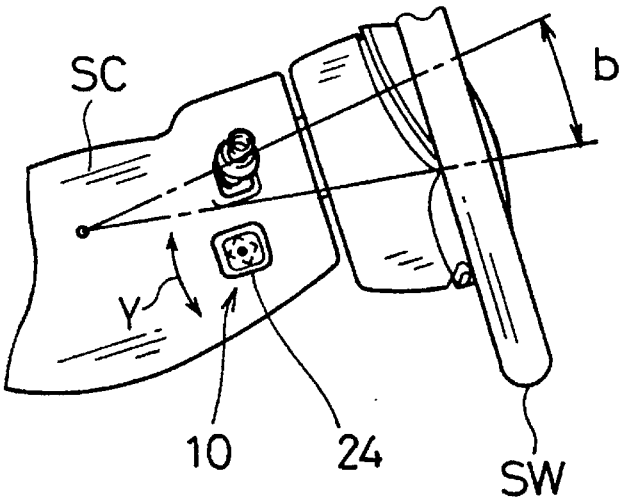
FIG. 3 shows rocking operations of the control knob 24 of the tilt and telescopic switch 10 in another direction to change another condition of the steering wheel SW.

A tilt and telescopic switch 10 of the embodiment is attached to a side face of a steering column SC as shown in FIG. 1, which is a schematic perspective view of a steering wheel SW and its surroundings. The tilt and telescopic switch 10 has a control knob 24 projected and exposed outside to be operable by the operator. According to the requirements, the operator rocks the control knob 24 either along an axis of a steering shaft or perpendicular to the axis of the steering shaft as shown by the double-headed arrows X and Y in FIG. 1. Rocking movements of the control knob 24 in the direction shown by the double-headed arrow X slide the steering wheel SW within a range of predetermined stroke 'a' as shown in FIG. 2. Rocking movements of the control knob 24 in the direction shown by the double-headed arrow Y vary the angle of inclination of the steering wheel SW within a range of predetermined angle 'b' as shown in FIG. 3. The amount of sliding or the degree and direction of inclination is determined by the rocking direction of the control knob 24 and the duration of its operation.

In the description below, like numerals denote like elements of the conventional tilt and telescopic switch 50 which are not specifically explained here.

Figure 4:
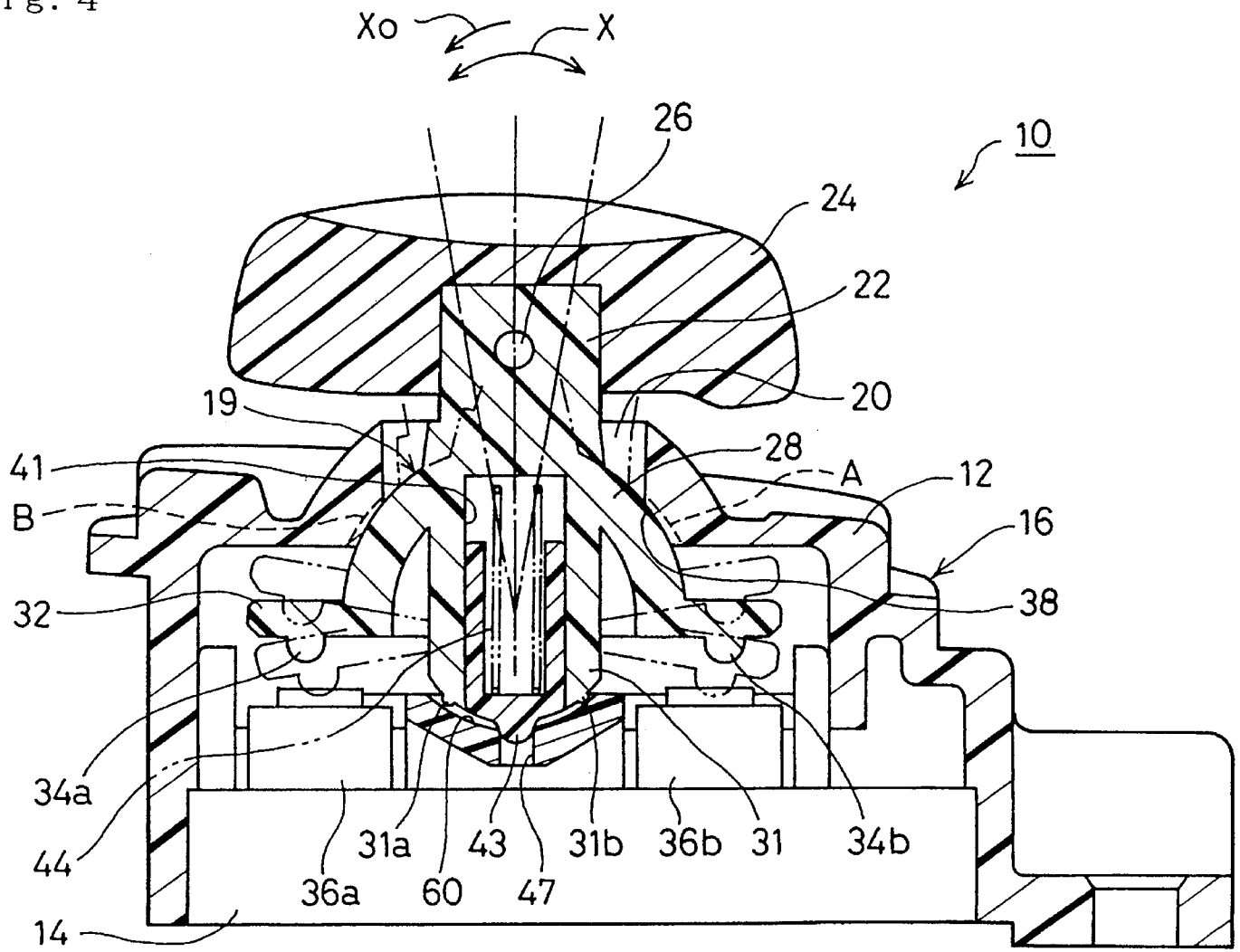
FIG. 4 is an enlarged cross sectional view illustrating the tilt and telescopic switch 10 of the embodiment, taken on the line 4—4 of FIG. 2.

As shown in the enlarged cross sectional view of FIG. 4 taken on the line 4—4 of FIG. 2, the tilt and telescopic switch 10 includes a main body 19 received and accommodated in the space defined by a switch casing 16, which is assembled by fitting a lower casing member 14 into a lower opening of an upper casing member 12. Like the main body 18 of the conventional tilt and telescopic switch 50, the main body 19 of the tilt and telescopic switch 10 includes a knob fixing member 22 projected upright, and the control knob 24 is fixed to the knob fixing member 22 by means of a pin 26.

Figure 5:
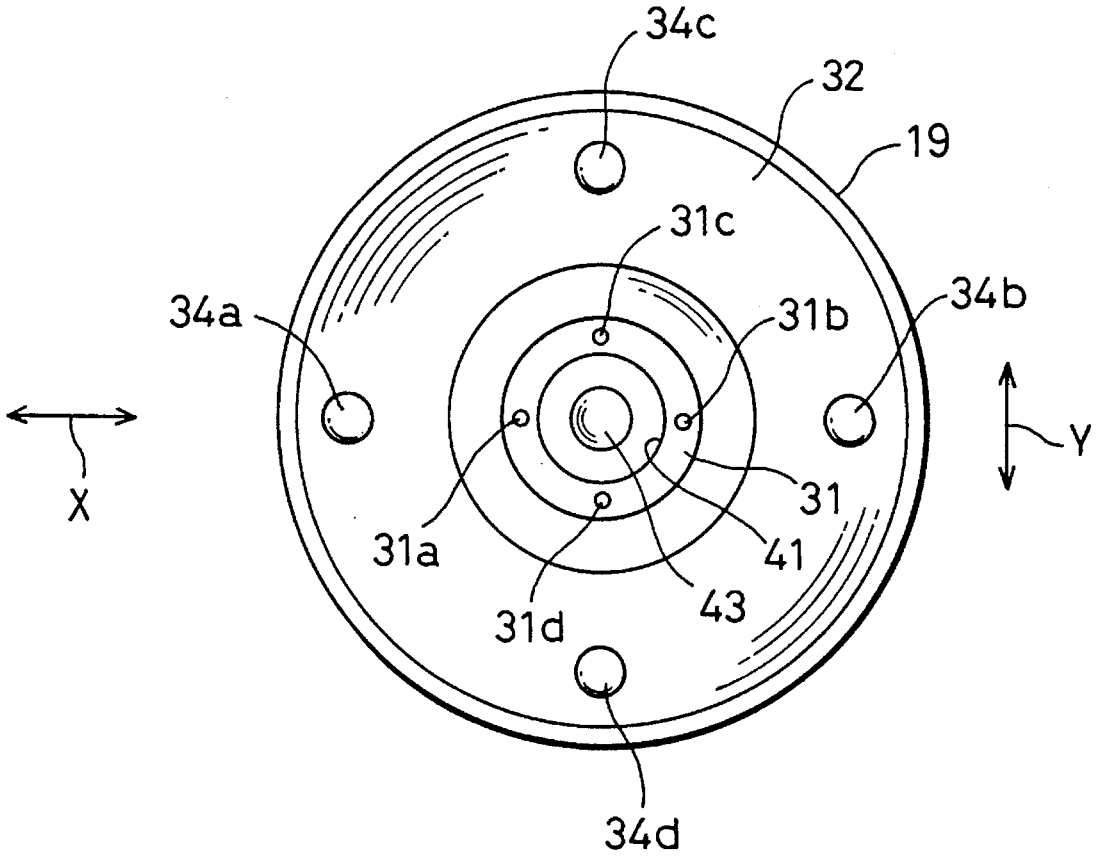
FIG. 5 is an enlarged bottom view illustrating the main body 19 of the tilt and telescopic switch 10.

The main body 19 includes a first hemispherical member 28 on the side close to the control knob 24, and a second hemispherical member 31 joined with the inner top portion of the first hemispherical member 28. The second hemispherical member 31 is disposed on the lower end of the main body 19 and concentrically arranged with the first hemispherical member 28. As shown in FIG. 4 and the bottom view of FIG. 5 showing the main body 19, four hemispherical projections 31*a*, 31*b*, 31*c*, and 31*d* are arranged at the equal pitches on the circumference of the second hemispherical member 31. The first and the second hemispherical projections 31*a* and 31*b* are arranged symmetrically and opposite to each other across a neutral position, at which the main body 19 is located in the drawing of FIG. 4. More concretely as shown in FIG. 5, the hemispherical projections 31*a* and 31*d* are symmetrically arranged in a rocking plane defined by the rocking movements of the main body 19 from the neutral position in the direction indicated by the double-headed arrow X. As clearly seen in FIG. 5, the third and the fourth hemispherical projections 31*c* and 31*d* are also arranged symmetrically and opposite to each other across the neutral position in a rocking plane defined by the rocking movements of the main body 19 from the neutral position in the direction indicated by the doubled-headed arrow Y, which is perpendicular to the direction X.

Like the main body 18 of the conventional tilt and telescopic switch 50, a plane ring 32 is formed as a rim of the lower opening of the first hemispherical member 28 in the main body of the tilt and telescopic switch 10. Four pressure projections 34*a* through 34*d* are arranged at the equal pitches on the lower face of the plane ring 32 to press the corresponding switching elements 36*a* through 36*d*. While receiving a pressure from the first pressure projection 34*a*, the first switching element 36*a* outputs a signal to shift the steering wheel SW toward the steering column SC. While receiving a pressure from the second pressure projection 34*b*, the second switching element 36*b* outputs a signal to shift the steering wheel SW away from the steering column SC. Application of the pressures to the first and the second switching elements 36*a* and 36*b* thus implements the telescopic control of the steering wheel SW. While receiving a pressure from the third pressure projection 34*c*, the third switching element 36*c* outputs a signal to shift the steering wheel SW in the direction that narrows the angle of inclination of the steering wheel SW. While receiving a pressure from the fourth pressure projection 34*d*, the fourth switching element 36*d* outputs a signal to shift the steering wheel SW in the direction that widens the angle of inclination of the steering wheel SW. Application of the pressures to the third and the fourth switching elements 36*c* and 36*d* thus implements the tilt control of the steering wheel SW.

The upper casing member 12 has a first hemispherical recess 38 formed to define the opening 20. The outer radius of the first hemispherical member 28 of the main body 19 is substantially equal to the inner radius of the first hemispherical recess 38. The lower casing member 14 has a second hemispherical recess 60, which faces the opening 20 and the first hemispherical recess 38 of the upper casing member 12. The second hemispherical recess 60 is arranged concentrically with the first hemispherical recess 38. When the upper casing member 12 is joined with the lower casing member 14, the first hemispherical recess 38 and the second hemispherical recess 60 define the space for receiving and accommodating the main body 19.

Under the condition that the main body 19 is received and accommodated in the space of the switch casing 16, the respective hemispherical projections 31*a* through 31*d* formed on the circumference of the second hemispherical member 31 of the main body 19 are projected against the hemispherical inner surface of the second hemispherical recess 60. A little clearance, however, remains between the tips of the hemispherical projections 31*a* through 31*d* and the hemispherical inner surface of the second hemispherical recess 60. This means that the radius of the second hemispherical member 31, the dimensions of the hemispherical projections 31*a* through 31*d*, and the radius of the second hemispherical recess 60 are set in the design process in order to make such a little clearance.

A chamber 41 formed in the center of the second hemispherical member 31 of the main body 19 receives a touch piece 43 and a spring 44 for pressing the touch piece 43. The touch piece 43 is freely movable toward and away from the second hemispherical recess 60 of the lower casing member 14. The touch piece 43 has a small-diametral projection on its lower end. A chamfered, small-diametral through hole 47 is formed on the center of the lower end of the second hemispherical recess 60 to receive the small-diametral projection of the touch piece 43.

The main body 19 accommodated in the switch casing 16 continuously receives the pressing force of the spring 44. The first hemispherical member 28 of the main body 19 accordingly comes into contact with the first hemispherical recess 38 over the substantially whole hemispherical surface thereof and is guided by the hemispherical inner surface of the first hemispherical recess 38. When the small-diametral projection of the touch piece 43 is fitted in the through hole 47 of the second hemispherical recess 60, the main body 19 is at the neutral position of the rocking movements. The action of guiding the first hemispherical member 28 by the hemispherical inner surface of the first hemispherical recess 38 rocks the main body 19 from the neutral position either in the direction shown by the double-headed arrow X or in the direction shown by the double-headed arrow Y (see FIGS. 1 and 5).

The tilt and telescopic switch 10 of the embodiment having the structure described above has advantages over the conventional tilt and telescopic switch 50. When the control knob 24 of the tilt and telescopic switch 10 is operated in the direction of the arrow X0 shown in FIG. 4, only the main body 19 rocks until the touch piece 43 comes into contact with the wall of the chamber 41. Because of the reason described above for the conventional tilt and telescopic switch 50, the main body 19 may be guided and rocked by only one side of the first hemispherical recess 38, for example, by a hemispherical portion A. The one-sided guide results in a deviation of the center of the rocking movement of the main body 19 from the center of the hemispherical surface of the first hemispherical member 28.

In the subsequent rocking movements of the main body 19 under such conditions, only the hemispherical projections 31*a* through 31*d* formed on the second hemispherical member 31 come into contact with the hemispherical inner surface of the second hemispherical recess 60. This means that the tilt and telescopic switch 10 of the embodiment allows only the point contact of the second hemispherical member 31 with the second hemispherical recess 60 via the hemispherical projections 31*a* through 31*d* during the rocking movements of the main body 19. This structure does not increase the required force for operating the control knob 24 and enhances the operating characteristics of the tilt and telescopic switch 10.

Even when the respective elements of the tilt and telescopic switch 10 satisfy the standard of dimensions, small errors in the dimensions or assembly may vary the clearance between the tips of the hemispherical projections 31*a* through 31*d* and the hemispherical inner surface of the second hemispherical recess 60 and change the positions of contact of the hemispherical projections 31*a* through 31*d* with the hemispherical inner surface of the second hemispherical recess 60. As described above, the tilt and telescopic switch 10 of the embodiment only allows the point contact of the second hemispherical member 31 with the second hemispherical recess 60 via the hemispherical projections 31*a* through 31*d* during the rocking movements of the main body 19. The structure of the embodiment thus requires the dimensions Of the respective elements to have the precision equivalent to or even lower than the precision required in the conventional structure. This reduces the time and labor required for the strict quality control and allows utilization of the existing equipment. In the tilt and telescopic switch 10 of the embodiment, the touch piece 43 has the small-diametral projection fitted in the small-diametral through hole 47 to ensure appropriate control of the control knob 24. This increases the area of the hemispherical inner surface of the second hemispherical recess 60 and allows the point contact of the hemispherical projections 31*a* through 31*d* with the second hemispherical recess 60 without the highly precise control of the dimensions of the second hemispherical recess 60, thereby reducing the manufacturing cost.

There may be many other modifications, alternations, and changes without departing from the scope or spirit of essential characteristics of the invention. It is thus clearly understood that the above embodiment is only illustrative and not restrictive in any sense. Some examples of modification are given below.

Figure 6:
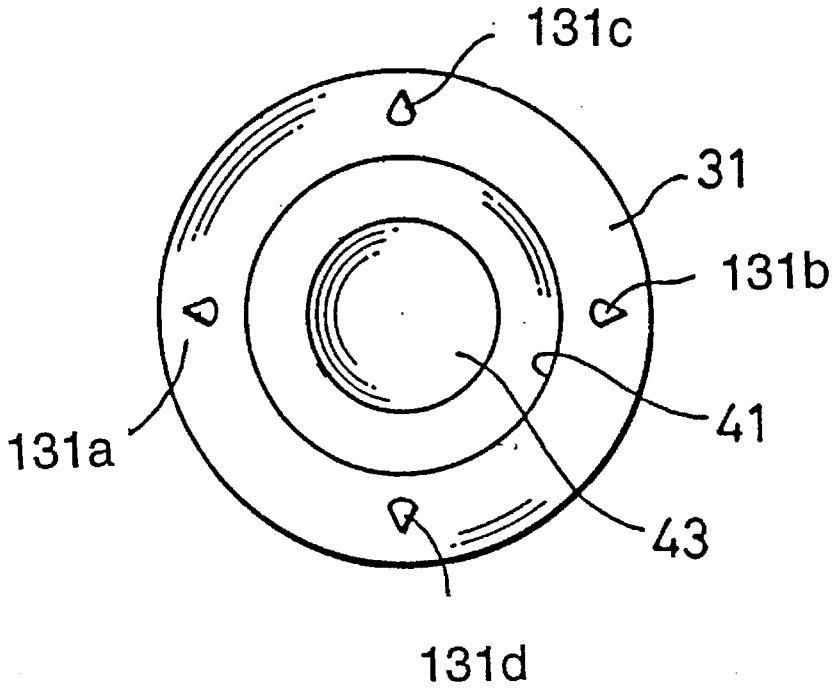
FIG. 6 is an enlarged bottom view illustrating essential part of the main body 19 having a modified structure.
Figure 7:
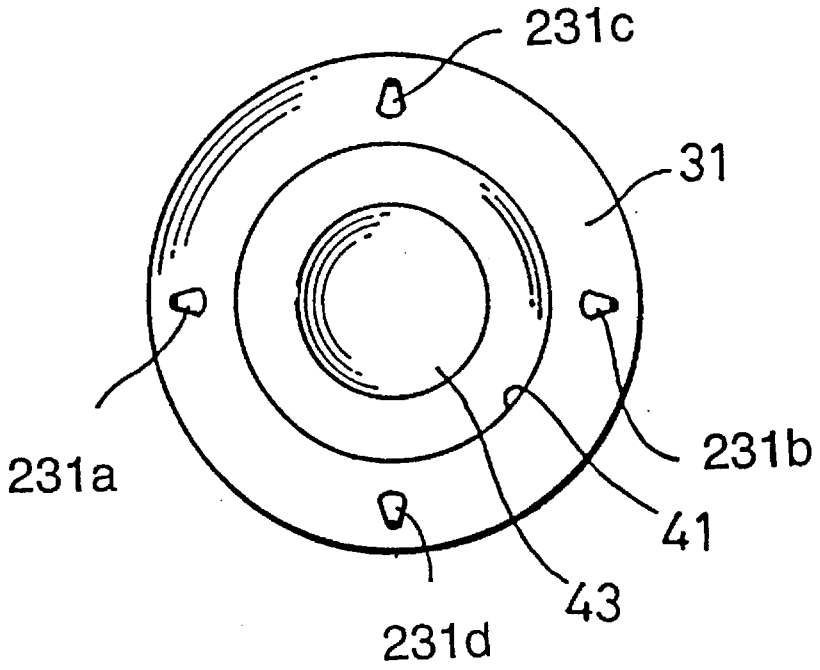
FIG. 7 is an enlarged bottom view illustrating essential part of the main body 19 having another modified structure.
Figure 8:
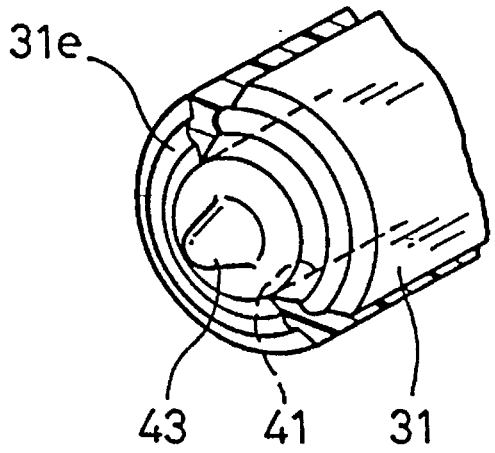
FIG. 8 is a partly broken, enlarged perspective view illustrating the second hemispherical member 31 of the main body 19 having another modified structure.
Figure 9:
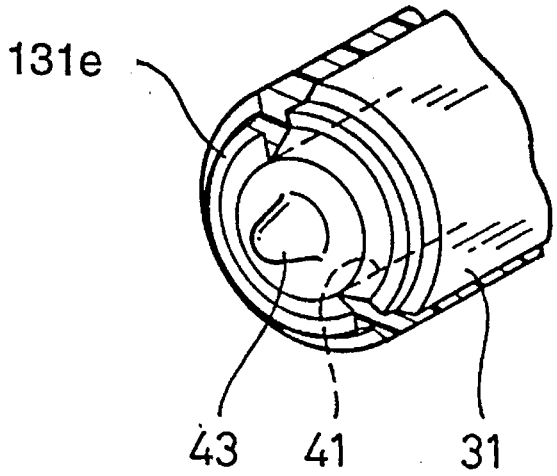
FIG. 9 is a partly broken, enlarged perspective view illustrating the second hemispherical member 31 of the main body 19 having still another modified structure.
Figure 10:
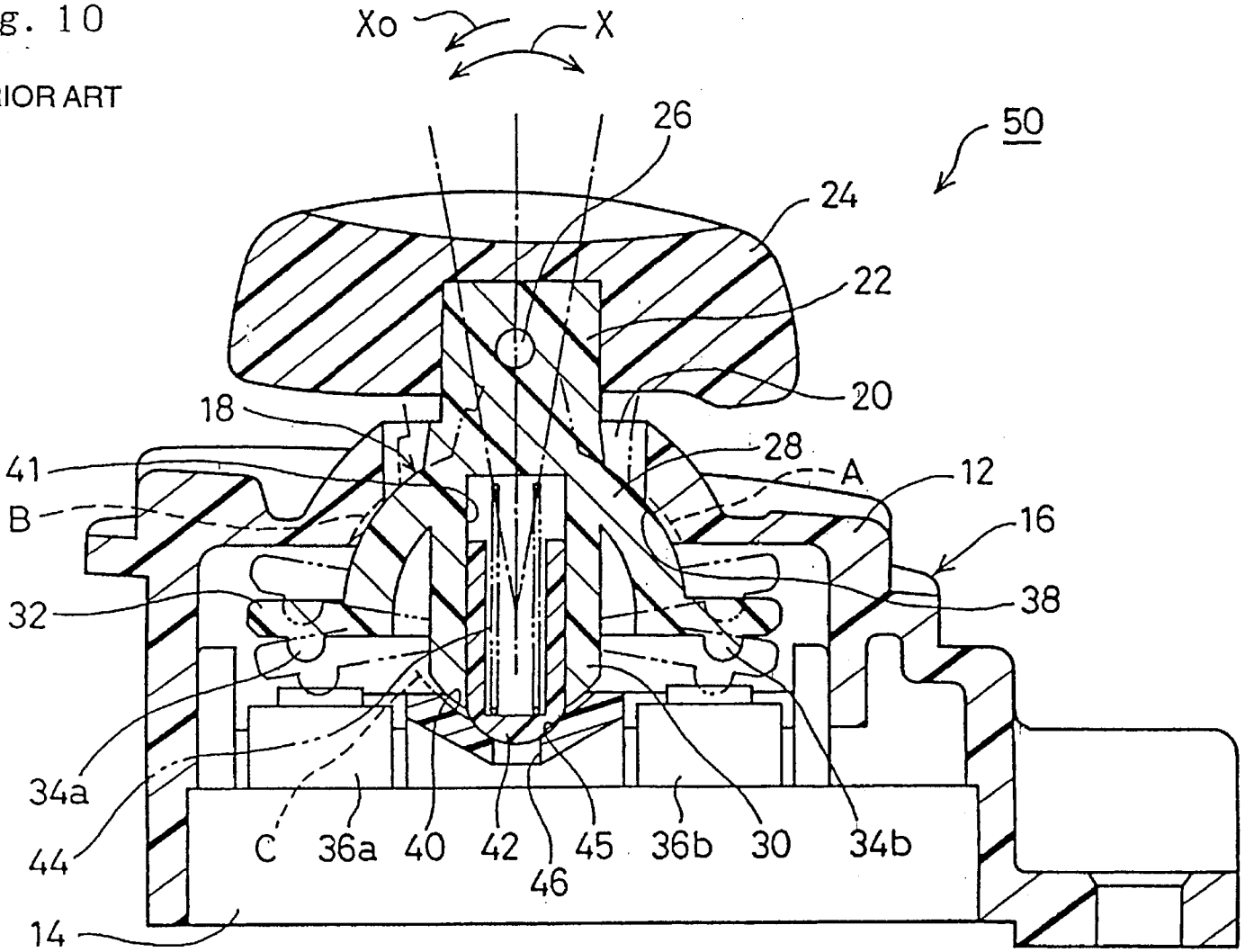
Fig. 10 PRIOR ART
FIG. 10 is a cross sectional view illustrating a conventional tilt and telescopic switch 50.

As shown in the enlarged bottom views of FIGS. 6 and 7, the hemispherical projections 31*a* through 31*d* shown in FIG. 5 formed on the second hemispherical member 31 may be replaced by cone-shaped projections 131*a* through 131*d* or truncated cone-shaped projections 231*a* through 231*d*. Alternatively, as shown in the partly broken, enlarged perspective view of FIG. 8, the second hemispherical member 31 may have a ring projection 31*e*, having a hemispherical cross section, formed around the circumference thereof. As shown in FIG. 9, the ring projection 31*e* shown in FIG. 8 may be replaced by a ring projection 131*e* having a cross section of cone or truncated cone shape.

The essential characteristics of the present invention are applicable to rocking switches for rocking in only one direction or for rocking in three or more different directions, other than the rocking switch for rocking in two directions crossing each other.

The scope and spirit of the present invention are limited only by the terms of the appended claims.

What is claimed:

1. A rocking switch for rocking forward from a neutral position thereof to a first rocking position and back from said neutral position to a second rocking position and outputting first and second switching signals at said first and said second rocking positions, respectively, said rocking switch comprising:

a main body rocked forward from said neutral position to said first rocking position and back from said neutral position to said second rocking position;

a switch casing for accommodating said main body to allow rocking movements of said main body, said switch casing having an opening on one end thereof;

a first switching element, formed in said switch casing, for outputting said first switching signal, said first switching element being pressed when said main body is rocked to said first rocking position;

a second switching element, formed in said switch casing, for outputting said second switching signal, said second switching element being pressed when said main body is rocked to said second rocking position; and a control knob fixed to said main body and projected through said opening of said switch casing, said control knob causing the rocking movements of said main body from said neutral position to said first rocking position and to said second rocking position in response to a rocking-forward and -back operation of said control knob; and wherein said main body comprising:

a first hemispherical member formed on a first side of said main body close to said control knob;

a second hemispherical member formed on a second side of said main body away from said control knob and arranged concentrically with said first hemispherical member;

a first pressure element for pressing said first switching element when said main body is rocked to said first rocking position; and a second pressure element for pressing said second switching element when said main body is rocked to said second rocking position; and said switch casing comprising:

a first hemispherical recess formed to define said opening of said switch casing for guiding said first hemispherical member of said main body along the hemispherical surface thereof; and a second hemispherical recess arranged concentrically with said first hemispherical recess to accommodate said second hemispherical member of said main body;

said second hemispherical member comprising a pair of first projections protruded against the hemispherical inner surface of said second hemispherical recess, said pair of first projections being arranged symmetrically and opposite to each other across said neutral position in a first rocking plane defined by said neutral position, said first rocking position, and said second rocking position.

2. A rocking switch in accordance with claim 1, said rocking switch comprising:

restoration means for returning said main body to said neutral position when said rocking-forward and -back operation of said control knob is released.

3. A rocking switch in accordance with claim 2, wherein said switch casing further comprises:

a third switching element being pressed when said main body is rocked forward from said neutral position to a third rocking position in a second rocking plane, which crosses said first rocking plane at said neutral position; and a fourth switching element being pressed when said main body is rocked back from said neutral position to a fourth rocking position in said second rocking plane; and said main body further comprises:

a third pressure element for pressing said third switching element when said main body is rocked to said third rocking position in said second rocking plane; and a fourth pressure element for pressing said fourth switching element when said main body is rocked to said fourth rocking position in said second rocking plane;

said second hemispherical member comprising a pair of second projections protruded against the hemispherical inner surface of said second hemispherical recess, said pair of second projections being arranged symmetrically and opposite to each other across said neutral position in said second rocking plane.

4. A rocking switch in accordance with claim 3, wherein each of said pair of first and second projections of hemispherical shape.

5. A rocking switch in accordance with claim 3, wherein each of said pair of first and second projections of cone shape.

6. A rocking switch in accordance with claim 3, wherein said first switching element comprises a first switching signal output element for outputting said first switching signal indicating to extend an axial length of a steering wheel in a vehicle, said second switching element comprises a second switching signal output element for outputting said second switching signal indicating to shorten the axial length of the steering wheel in the vehicle, said third switching element comprises a third switching signal output element for outputting a third switching signal indicating to widen an angle of inclination of the steering wheel in the vehicle;

said fourth switching element comprises a fourth switching signal output element for outputting a fourth switching signal indicating to narrow the angle of inclination of the steering wheel in the vehicle.

7. A rocking switch in accordance with claim 1, wherein each of said pair of first projections has a hemispherical shape.

8. A rocking switch in accordance with claim 1, wherein each of said pair of first projections has a cone shape.

9. A rocking switch for rocking forward from a neutral position thereof to a first rocking position and back from said neutral position to a second rocking position and outputting first and second switching signals at said first and second rocking positions, respectively, said rocking switch comprising:

a main body rocked forward from said neutral position to said first rocking position and back from said neutral position to said second rocking position;

a switch casing for accommodating said main body to allow rocking movements of said main body, said switch casing having an opening on one end thereof;

a first switching element, formed in said switch casing, for outputting said first switching signal, said first switching element being pressed when said main body is rocked to said first rocking position;

a second switching element, formed in said switch casing, for outputting said second switching signal, said second switching element being pressed when said main body is rocked to said second rocking position; and a control knob fixed to said main body and projected through said opening of said switch casing, said control knob causing the rocking movement of said main body from said neutral position to said first rocking position and to said second rocking position in response to a rocking-forward and -back operation of said control knob; and wherein said main body comprising:

a first hemispherical member formed on a first side of said maid body close to said control knob;

a second hemispherical member formed on a second side of said maid body away from said control knob and arranged concentrically with said first hemispherical member;

a first pressure element for pressing said first switching element when said main body is rocked to said first rocking position; and a second pressure element for pressing said second switching element when said main body is rocked to said second rocking position; and said switch casing comprising:

a first hemispherical recess formed to define said opening of said switch casing for guiding said first hemispherical member of said main body along the hemispherical surface thereof; and a second hemispherical recess arranged concentrically with said first hemispherical recess to accommodate said second hemispherical member of said main body;

said second hemispherical member comprising a ring projection protruded against the hemispherical inner surface of said second hemispherical recess.

10. A rocking switch in accordance with claim 9, said rocking switch comprising:

restoration means for returning said main body to said neutral position when said rocking-forward and -back operation of said control knob is released.

11. A rocking switch in accordance with claim 10, wherein said switch casing further comprises:

a third switching element being pressed when said main body is rocked forward from said neutral position to a third rocking position in a second rocking plane, which crosses at said neutral position a first rocking plane defined by said neutral position, said first rocking position, and said second rocking position; and a fourth switching element being pressed when said main body is rocked back from said neutral position to a fourth rocking position in said second rocking plane, said main body further comprises:

a third pressure element for pressing said third switching element when said main body is rocked to said third rocking position in said second rocking plane; and a fourth pressure element for pressing said fourth switching element when said main body is rocked to said fourth rocking position in said second rocking plane.

12. A rocking switch in accordance with claim 11, wherein said ring projection has a hemispherical cross section along said first rocking plane.

13. A rocking switch in accordance with claim 11, wherein said ring projection has a cone-shaped cross section along said first rocking plane.

14. A rocking switch in accordance with claim 9, wherein said ring projection has a hemispherical cross section along said first rocking plane.

15. A rocking switch in accordance with claim 9, wherein said ring projection has a cone-shaped cross section along said first rocking plane.

* * * * *